United States Patent [19]

Orsini

[11] Patent Number: 4,675,916

[45] Date of Patent: Jun. 30, 1987

[54] UMBRELLA HAT WITH ELASTIC PERIPHERAL COMPONENTS

[76] Inventor: Jean-Francois Orsini, 4110 Fessenden St. N.W., Washington, D.C.

[21] Appl. No.: 837,151

[22] Filed: Mar. 7, 1986

[51] Int. Cl.[4] ..... A42B 1/06; A45B 19/00

[52] U.S. Cl. ..... 2/209.1; 2/175; 2/185 R; 2/177; 135/16; 135/25 R; 135/109; 135/19.5

[58] Field of Search ..... 2/175, 209.1, 177, 185 R; 135/20 R, 16, 25 R, 19.5, 106, 109

[56] References Cited

U.S. PATENT DOCUMENTS

| | | | |
|---|---|---|---|
| 213,415 | 3/1879 | Halvorson | 2/177 X |
| 2,147,872 | 2/1939 | Wittcoff | 2/175 X |
| 2,412,415 | 12/1946 | Navon | 135/16 X |
| 2,495,041 | 1/1950 | Weiss | 2/177 X |
| 2,563,353 | 8/1951 | Mueller et al. | 135/19.5 |
| 3,441,038 | 4/1969 | Mathews | 135/20 |
| 3,448,748 | 6/1969 | Walrave | 135/106 X |
| 3,452,765 | 7/1969 | Slaton . | |
| 3,987,807 | 10/1976 | Varnell | 135/22 |
| 4,236,543 | 12/1980 | Moss | 135/106 X |
| 4,312,371 | 1/1982 | Koon | 135/19.5 |
| 4,370,994 | 2/1983 | Pittman | 135/20 B |

FOREIGN PATENT DOCUMENTS 3034376 4/1982 Fed. Rep. of Germany .

*Primary Examiner*—William Price
*Assistant Examiner*—T. Graveline
*Attorney, Agent, or Firm*—Nixon & Vanderhye

[57] ABSTRACT

A precipitation protecting device that may be configured as a wide brimmed hat, or as an umbrella like covering. The device is movable from a collapsed, low volume configuration in which it is easily transported or stored, to a deployed configuration in which it well protects a user's head and upper body. A covering of flexible material, which may be transparent, has a relatively rigid perimeter defined by a plurality of distinct rigid tubular elongated support members. The support members may be tubular, or may be bars or other solid structures. An elastic structure, such as an elastic band, operatively connects the support members so that they are movable from the low volume configuration in which the members are generally side-by-side, to the deployed configuration in which adjacent elements are connected end-to-end to define a relatively rigid perimeter for the flexible covering. When used as a hat, the flexible covering is connected to a wearer's head by a headband, straps, or the like, at a central portion of the flexible covering. In an umbrella embodiment, a handle engages a central portion of one side of the flexible covering, the handle being unconnected to the relatively rigid perimeter.

20 Claims, 13 Drawing Figures

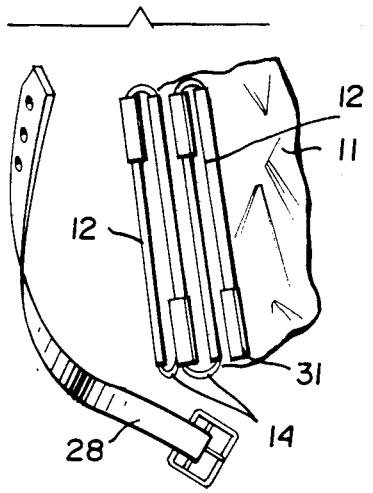
FIG. 1
FIG. 2
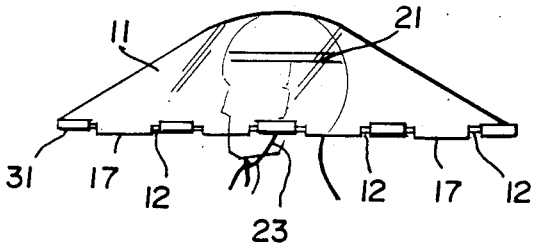
FIG. 4
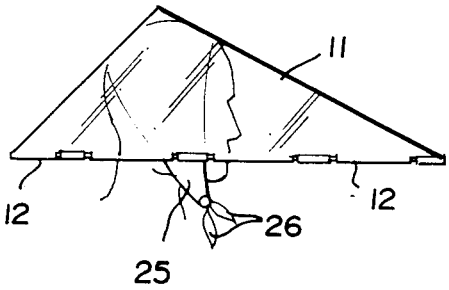
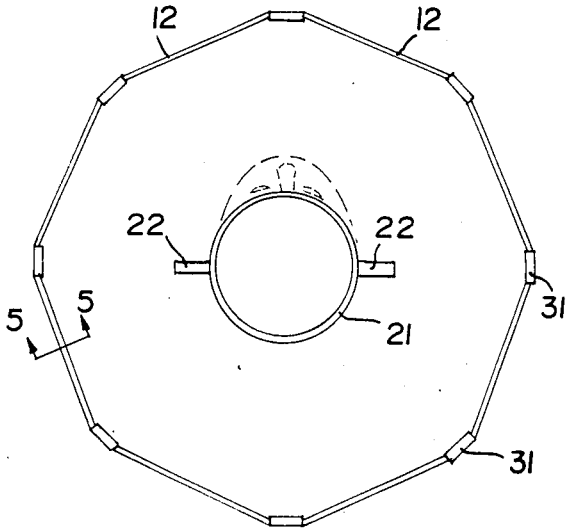
FIG. 3
FIG. 5
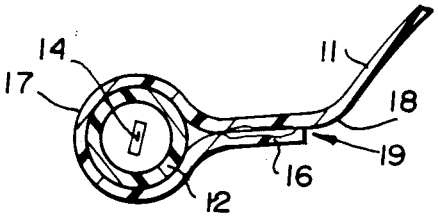
FIG. 6
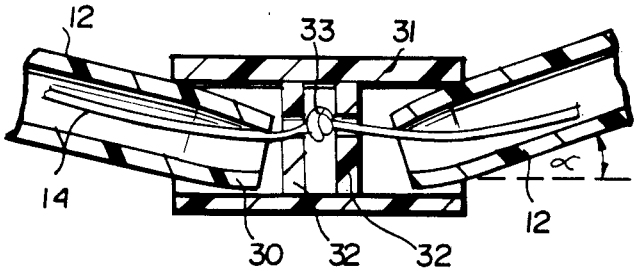

UMBRELLA HAT WITH ELASTIC PERIPHERAL COMPONENTS

BACKGROUND AND SUMMARY OF THE INVENTION

Over the years, a wide variety of devices have been utilized by people in an attempt to keep themselves dry outdoors when it is raining, snowing, or there is other precipitation. Common devices include umbrellas and wide brimmed hats.

Umbrellas can be collapsed into a relatively low volume configuration and perform the precipitation-protection function very well under many circumstances. However they require that the user use his/her hands to maintain them in a proper position, and they have a relatively delicate construction which can fail catastrophically upon certain wind loadings. Large brimmed hats also can be advantageous, however they are difficult to store properly and transport from place to place when not needed to protect a wearer from precipitation.

According to the present invention, a device is provided which can function as an umbrella or a large brimmed hat, and which is readily collapsible into a low volume configuration, and deployable into a precipitation-protecting configuration. The device according to the invention is constructed of relatively simple components, is unlikely to fail catastrophically, and can properly protect the head and upper body of a wearer while allowing the wearer's hands to remain free.

The precipitation-protecting device according to the invention comprises a covering of flexible material, such as cloth treated to be water repellant, transparent plastic, or the like, with a perimeter means for the covering. The perimeter means includes a plurality of distinct relatively rigid support members, such as a plurality of hard plastic tubular members. Elastic means are provided for operatively connecting the tubular members so that they are movable from a first, low volume configuration in which a plurality of the members are side-by-side and the flexible covering is folded and bunched up, to a second, deployed configuration in which adjacent tubular elements are connected together in end-to-end relationship to define a relatively rigid perimeter for the flexible covering. The perimeter is in the form of a closed loop, such as a polygon approximating a circle or ellipse.

The perimeter may also comprise tubular retaining elements between the support members. The elastic means preferably comprises one or more bands of elastic material that extend through one or more of the tubular support members, and are held to the tubular retaining means as by abutments and knots, or clamps. A single continuous band of non-metallic elastic material may pass through all of the support members and bias them together in the deployed configuration, or a closed lopp band of elastic material may be provided at each joint between adjacent support elements.

Preferably, the flexible covering is supported at a central portion thereof, interior of the perimeter. Support is preferably provided by fastening means for attaching the flexible covering to a wearer's head (such as headband and/or straps). Alternatively, however, if the wearer does not wish to use the device as a hat, a handle may be provided which merely engages the undersurface of the flexible covering at a central portion thereof to allow the flexible covering to be held over the wearer's head. The handle is unconnected to the perimeter means.

It is the primary object of the present invention to provide an effective and versatile device for protecting a user from precipitation. This and other objects of the invention will become clear from an inspection of the detailed description of the invention and from the appended claims.

BRIEF DESCRIPTION OF THE DRAWINGS

FIG. 1 is a perspective view an exemplary device according to the present invention shown in a low volume, collapsed, configuration;

FIGS. 2 and 3 are side and top views respectively of the device of FIG. 1 shown in a deployed, precipitation-protecting, configuration;

FIG. 4 is a side schematic view of another form the device according to the present invention could take;

FIG. 5 is a cross-sectional detail view taken along the section line 5—5 in FIG. 3, and showing a manner of interconnection between the flexible covering and a tubular support member;

FIG. 6 is a detail cross-sectional view showing an exemplary inter-relationship between adjacent tubular support members, a tubular retainer means, and an elastic band;

DETAILED DESCRIPTION OF THE DRAWINGS

Figure 7:
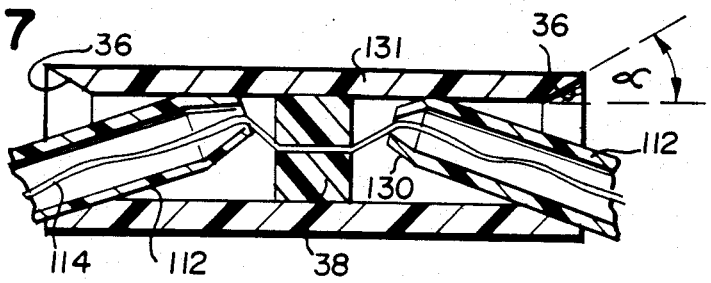
FIG. 7 is a cross-sectional detail view like that of FIG. 6 only showing a different embodiment.

Basic elements of the precipitation-protecting device according to the present invention include a covering 11 of flexible material, and a perimeter means for the covering including a plurality of distinct relatively rigid support members 12. Elastic means, such as a band of non-metallic elastic material 14 (see FIGS. 1 and 6) provide for operative connection of the members 12 so that they are movable from a first, collapsed, low volume configuration (as illustrated in FIG. 1) in which a plurality of the members 12 are generally in side-by-side relationship and the flexible covering 11 is folded and/or bunched up, to a second, deployed configuration (FIGS. 2 and 3) in which adjacent support members 12 are generally connected end-to-end to define a relatively rigid perimeter for the flexible covering 11.

The flexible covering 11 may comprise any suitable flexible material that will perform a precipitation protecting function. For instance the covering 11 may comprise a fabric sheet treated to be water repellant, or a sheet of plastic. The material forming the covering 11 may be completely transparent (as illustrated in the embodiments of FIGS. 2 through 4), or may be completely opaque, or may include a portion that is transparent (see FIG. 13).

The support members 12 preferably comprise tubular elements (see FIGS. 5 and 6), such as hard plastic tubes. The flexible covering 11 may be operatively connected to the rigid support members by any suitable means, such as is illustrated in FIGS. 2 and 5. As can be seen in FIGS. 2 and 5, a plurality of free ends 16 of the flexible covering 11 are provided, which are looped around the members 12 to form a loop 17, and then fastened to a surface 18 of the flexible covering 11. Fastening of a free end 16 to the surface 18 may be by any suitable conventional means, depending upon the particular material utilized. In FIG. 5 attachment between the free end 16 and the surface 18 is provided by adhesive 19, but alternatively fastening could be accomplished by stitching, ultrasonic welding, heat sealing, or the like.

The elastic means may also take a wide variety of configurations. The preferred configuration is a band of elastic material 14, such as a band of rubber, synthetic rubber, or cloth having stretchable elements (such as cloth made of Spandex yarn, or including a significant proportion of Spandex yarn). Under some circumstances, metallic bands, or spring elements (such as a coil spring) could be utilized, however since the metallic elements may degrade when exposed to significant amounts of moisture, non-metallic materials are preferred.

The device according to the present invention is preferably utilized as a wide brimmed hat. Therefore, means are provided for attaching the flexible covering 11 to a wearer's head. In the embodiment of FIGS. 2 and 3, such means for fastening the covering 11 to a wearer's head takes the form of a headband 21, which is attached to the inside surface of the covering 11 by strips of material 22 (see FIG. 3) or the like, and optionally a strap or tie string 23 that is connected to the headband 21 and fastens under the wearer's chin. Alternatively, straps of material fastened to the inside surface of the covering 11 could be utilized, as illustrated in FIG. 4. In FIG. 4 the hat is shown as having a generally conical shape in the deployed condition, with straps 25 affixed to the interior surface of the covering 11 and tying its free ends 26 thereof beneath the wearer's chin.

The device according to the invention provides its precipitation-protecting function when in a deployed configuration (as illustrated in FIGS. 2 through 4), and in the collapsed configuration of FIG. 1 it may be readily transported. In order to ensure that the device remains in low volume configuration when collapsed as in FIG. 1, a strap 28, or like device, may be utilized for surrounding the device and maintaining its components close together.

Various ways that the support members 12 may be interconnected together in the deployed configuration are illustrated in FIGS. 6 through 12.

FIG. 6 shows an embodiment in which the ends 30 of the support members 12 are tapered, and are connected together through tubular retaining means (elements), such as the element 31. The inside diameter of the element 31 is somewhat greater than the outside diameter of the support members 12, so that the support members 12 may assume an angular orientation—see angle $\alpha$ in FIG. 6—with respect to the retainer 31, and thus an angular relationship of 180° minus $2\alpha$ with respect to each other. The tubular retainer 31 retains elastic band 14 in a particular position within it, so that there is no significant slippage of the band 14 within the elements, and a uniform biasing force is provided by the band 14. In the embodiment illustrated in FIG. 6 this retaining function is provided by a pair of abutment means in the form of annular interior walls 32, and a knot 33 formed in the elastic band 14 and maintained between the walls 32 and abutting one or both thereof.

Note that when the device is deployed, as best seen in FIG. 3, the perimeter has a polygonal configuration. However normally so many members 12 (which preferably are all of the same length) are provided that the angles $\alpha$ are small enough so that the perimeter approximates a circle or an ellipse.

In the FIG. 7 embodiment, elements corresponding to those in the FIG. 6 embodiment are shown by the same reference numeral only preceded by a "1". The most significant differences between the FIG. 7 and the FIG. 6 embodiment is in the provision of the tapered ends 36 of the retainer tube 131 (which are in the form of sections of cones and define an angle $\alpha$), and a clamping component 38 disposed interiorly of the retainer tube 131, and clamping the elastic band 114 so that it is held in place within the retainer 131.

Figure 8:
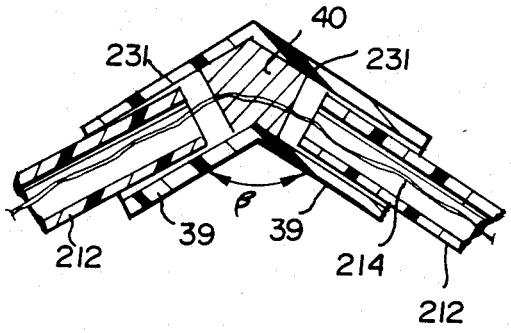
FIGS. 8 through 10 are cross-sectional views of other embodiments of interconnections between perimeter defining components of the device according to the invention.

In the embodiment of FIG. 8, components functionally similar to those in the embodiment of FIG. 6 are indicated by the same reference numeral only preceded by a "2". The major distinction between this embodiment and the embodiment of FIG. 6 is that the tubular retainer 231 has arm portions 39 thereof which are disposed at an angle $\beta$ with respect to each other, the angle $\beta$ equal to 180° minus $2\alpha$. Also in this embodiment a solid block of material 40 is provided at the juncture between the two arms 39, which block frictionally engages the elastic band 214 and retains it in place.

Figure 9:
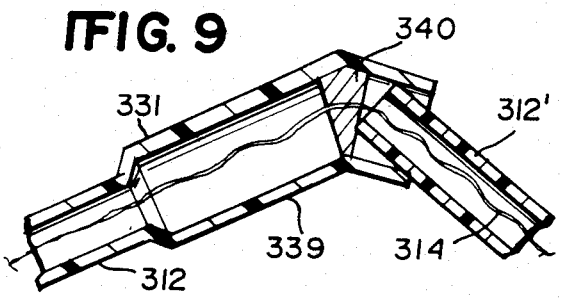

In the FIG. 9 embodiment, structures functionally related to those in the FIGS. 6 and 8 embodiment are shown by the same two digit reference numeral only preceded by a "3". The major distinction between this embodiment and the FIG. 8 embodiment is that one of the tubular support members 312 is integral with one of the arms 339 of the tubular retainer 331, while the other tube support 312' remains unconnected.

Figure 11:
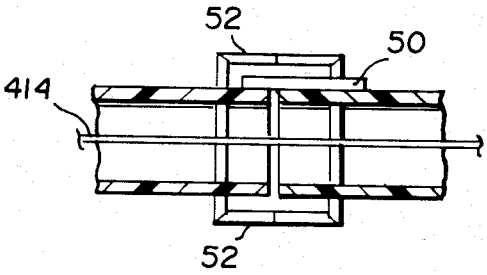
FIG. 11 is a side cross-sectional view of the device of FIG. 10.
Figure 10:
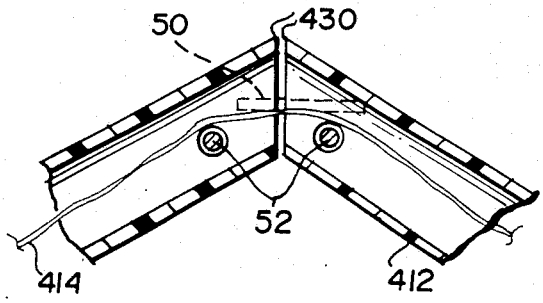

In the FIGS. 10 and 11 embodiment, structures functionally related to those in the FIG. 6 embodiment are shown by the same reference numeral only preceded by a "4". In this embodiment, instead of a tubular retainer being disposed between the support members 412, the members 412 abut each other at the ends 430 thereof, and additionally a retainer lip 50 (see FIG. 11) which is a top sectional view of the arrangement shown in FIG. 10 is provided on one of the support members 412. Also, a retaining ring 52 is provided which is pivotally connected to the tubular supports 412, and which may terminate in the sidewalls of the support tubes 412, or may pass therethrough and over which the elastic band 14 may wrap (as illustrated in FIG. 11). The rings 52 between adjacent components 412 provide articulation thereof. Articulated components 412 (whether or not tubular) could also be provided by mounting the ends thereof side-by-side, with rivets connecting them together.

Figure 12:
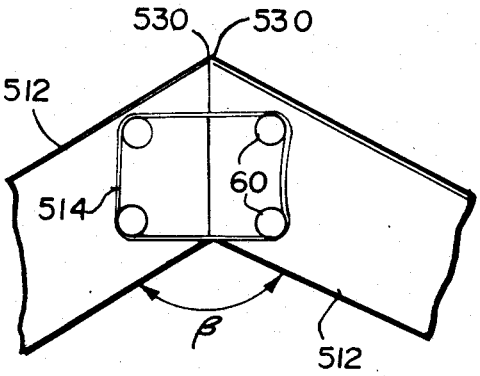
FIG. 12 is a top plan view of yet another form of perimeter defining components that may be utilized in a device according to the invention.

FIG. 12 shows an embodiment in which the particular forms that the elastic means and support elements take are different. Components in this embodiment functionally similar to those in the FIG. 6 embodiment are illustrated by the same reference numeral only preceded by a "5". In this embodiment, the supports 512 are not tubular, but are solid bars, and they abut each other at the flat, quadrate ends 530 thereof, and form the angle $\beta$. The elastic means is in the form a closed loop elastic material band 514 which extends around retainers in the form of posts 60 spanning the interior of the bar supports 512. A closed loop elastic band 514 is provided at the juncture of each of the bar supports 512.

Figure 13:
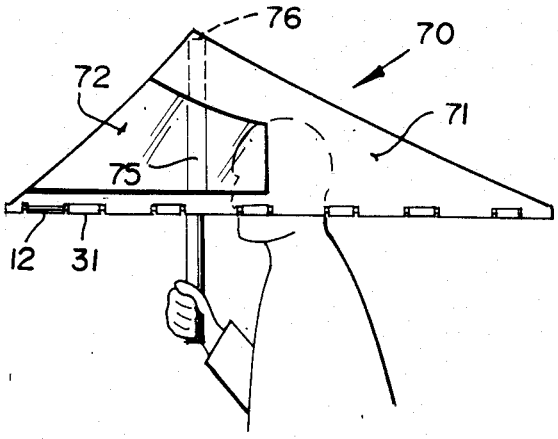
FIG. 13 is a side view of another embodiment of the precipitation-protecting device according to the invention.

While it is preferred that the device according to the invention be utilized as a hat, it may also be utilized as an umbrella. In FIG. 13, a flexible covering 70 is illustrated which is comparable to the flexible covering 11 except that it has an opaque portion 71, and a transparent window portion 72. The perimeter means, which may be defined by elements 12, 31, is identical to that in the other embodiments. The support for a central portion of the flexible covering 70 is different, being provided by a handle 75. The handle 75 merely engages the upper interior of the flexible covering 70 at a central portion, shown generally at reference numeral 76, thereof. Note that the handle 75 may be rigidly or detachably connected to the flexible covering by any suitable means, such as adhesive, hook and loop strips (e.g. VELCRO), or the like, and does not interfere with collapsing of the device to the low volume configuration. The handle 75 is unconnected to the perimeter means, such as defined by the elements 12, 31.

It will thus be seen that according to the present invention a simple and effective precipitation-protecting device has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A combined umbrella and hat comprising:

a covering of flexible material;

a perimeter means for said covering including a plurality of distinct relatively rigid elongated support members disposed about a free edge of said covering; and elastic means for operatively connecting said support members together so that they are movable from a first, low volume, configuration in which a plurality of said element are side-by-side and said flexible covering is folded and bunched up, to a second, deployed configuration in which adjacent support elements are connected generally end-to-end to define a relatively rigid perimeter for said flexible covering.

2. A device as recited in claim 1 wherein said perimeter means further comprises a plurality of tubular retainer means disposed between, and operatively connecting in said deployed configuration, said elongated support members.

3. A device as recited in claim 2 wherein said rigid support members comprise tubular support members and wherein said elastic means comprises an elastic element extending through said tubular support members and held by holding means so that it is relatively stationary within at least one of said tubular retaining means.

4. A device as recited in claim 3 wherein said elastic means comprises a band of elastic material.

5. A device as recited in claim 4 wherein said holding means comprises abutment means formed within said tubular retainer means, and a knot formed in said band of elastic material, said knot abutting said abutment means.

6. A device as recited in claim 1 wherein said support members comprise solid bars.

7. A device as recited in claim 1 wherein said support members comprise tubular support members, and wherein said elastic means comprises a continuous band of non-metallic elastic material extending through said plurality of support members to bias said support members to said second, deployed, configuration.

8. A device as recited in claim 1 wherein said elastic means comprises a closed loop band of elastic material at each joint between adjacent support members.

9. A device as recited in claim 1 further comprising means for supporting said flexible covering at a central portion thereof, interior of said perimeter.

10. A device as recited in claim 9 wherein said means for supporting said flexible covering comprises fastening means for attaching said flexible covering to a wearer's head.

11. A device as recited in claim 10 wherein said flexible covering assumes a generally conical configuration in said second, deployed, configuration, and wherein said fastening means comprises strap means for tying under the wearer's chin.

12. A device as recited in claim 9 wherein said supporting means comprises handle means unconnected to said perimeter means except through said flexible covering, and for holding the flexible covering above a user's head.

13. A device as recited in claim 1 further comprising means for fastening said flexible covering to said elongated support members in a central portion of said support members.

14. A device as recited in claim 13 wherein said fastening means comprises a plurality of free ends of said flexible covering, each free end looped around an elongated support member and attached to the surface of said flexible covering.

15. A device as recited in claim 14 wherein attachment of the free ends to said flexible covering is by adhesive.

16. A device as recited in claim 1 wherein said flexible material comprises a sheet at least a part of which is formed of transparent plastic material.

17. A precipitation protecting wide brimmed hat comprising:

a water repellant sheet of flexible material;

attaching means for attaching said sheet at a central portion thereof to a wearer's head; and a relatively rigid perimeter portion of said water repellent sheet comprising a plurality of distinct rigid elongated support members held together to define a closed loop relatively rigid perimeter of said hat.

18. A hat as recited in claim 17 wherein said elongated support members are held together by holding means comprising elastic means for biasing said support members toward each other in generally end-to-end relationship.

19. A hat as recited in claim 18 further comprising connector elements disposed between said support members, said elastic means operatively connected to at least some of said connector elements.

20. A hat as recited in claim 18 wherein said elongated support members are tubular members, and wherein said elastic means comprises at least one elastic band extending through said tubular support elements.

* * * * *